United States Patent [19]

Hammond

[11] 4,258,517

[45] Mar. 31, 1981

[54] FRAMING STRUCTURE FOR A FLEXIBLE PANE

[76] Inventor: Leonard A. Hammond, 12660 SE. 122nd, Portland, Oreg. 97266

[21] Appl. No.: 933,875

[22] Filed: Aug. 15, 1978

[51] Int. Cl.[3] ..... E06B 3/28

[52] U.S. Cl. ..... 52/202; 160/269; 160/290 R

[58] Field of Search ..... 52/202, 203; 160/269, 160/270, 271, 267, 290, 392, 395, 23

[56] References Cited

U.S. PATENT DOCUMENTS

| | | | |
|---|---|---|---|
| 1,743,517 | 1/1930 | Anfinrud | 160/267 |
| 1,911,232 | 5/1933 | Large | 160/266 |
| 2,009,917 | 7/1935 | Flanagan | 160/267 |
| 2,548,041 | 4/1951 | Morse | 160/23 |
| 2,624,403 | 1/1953 | Zelenko | 160/100 |
| 2,870,831 | 1/1959 | Peselnick | 160/269 X |
| 3,017,927 | 1/1962 | Demko | 160/271 |
| 3,158,195 | 11/1964 | Ney | 160/290 R |
| 3,196,935 | 7/1965 | Christensen | 160/290 R |
| 3,797,553 | 3/1974 | Elliott | 160/267 |
| 3,882,921 | 5/1975 | Sandall | 160/266 |
| 3,991,806 | 11/1976 | Abell | 160/392 |

FOREIGN PATENT DOCUMENTS

| | | | |
|---|---|---|---|
| 1034276 | 6/1966 | United Kingdom | 52/202 |
| 1104258 | 2/1968 | United Kingdom | 160/290 R |

*Primary Examiner*—J. Karl Bell

*Attorney, Agent, or Firm*—Klarquist, Sparkman, Campbell, Leigh, Whinston & Dellett

[57] ABSTRACT

An assembly for securing a one-piece flexible pane within an opening defined by a frame is disclosed. The assembly includes parallel edge channel members which receive side boundary portions of the pane by compressively gripping the boundary portions between opposed base and arch portions of the channel members. End portions of the pane are secured on a roller and/or pane guide members having ribs which are received by resilient elongated base strips mounted on the frame.

16 Claims, 17 Drawing Figures

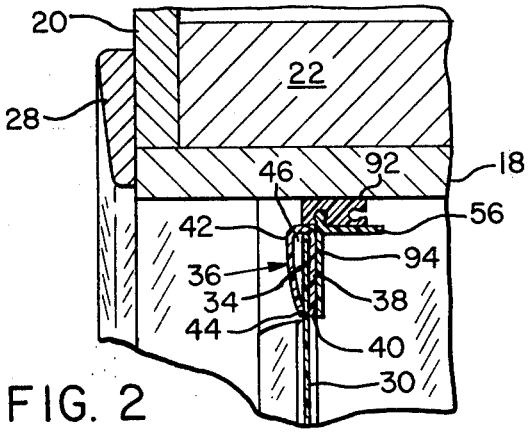
FIG. 2
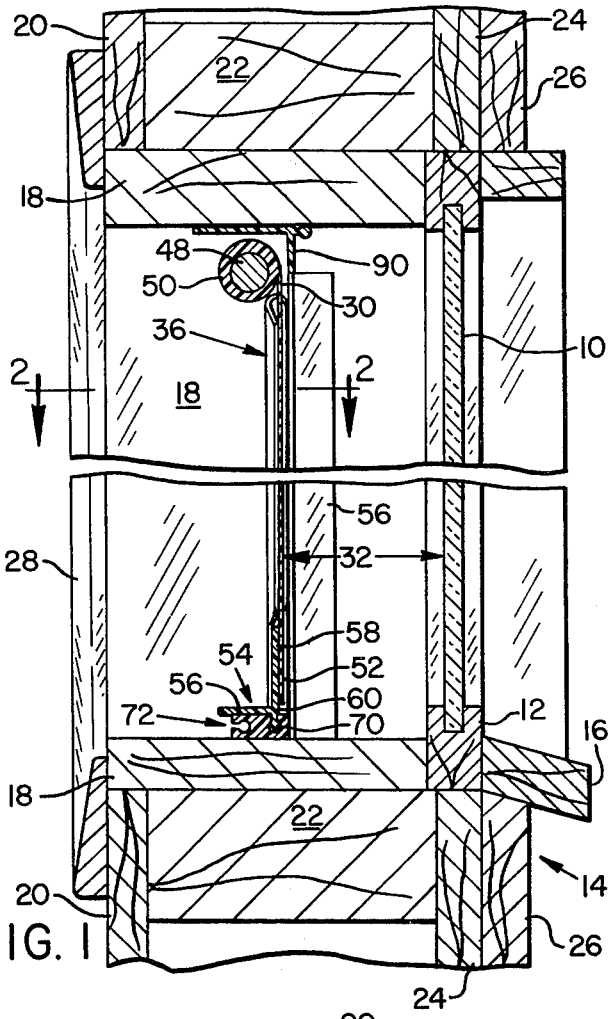
FIG. 1
FIG. 3
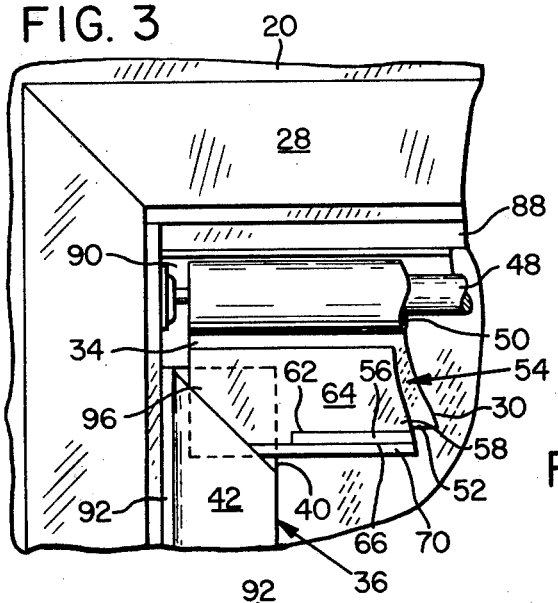
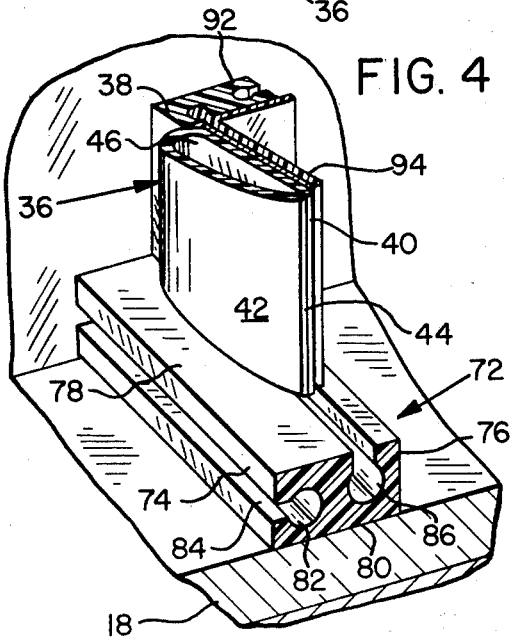
FIG. 4
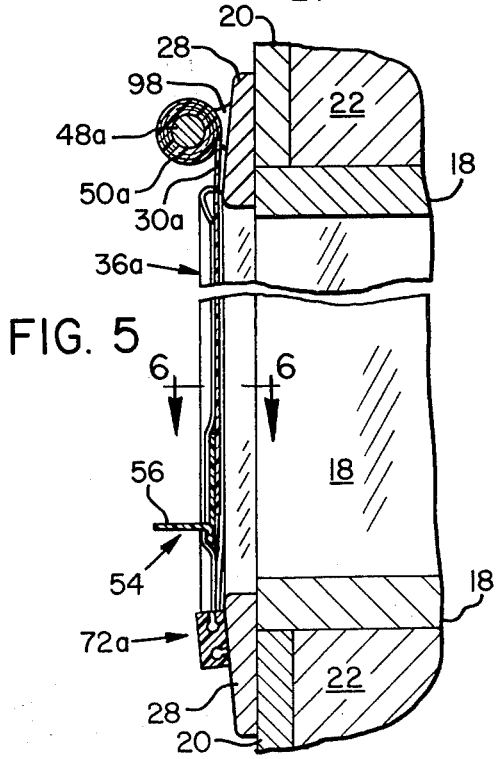
FIG. 5

FIG. 6
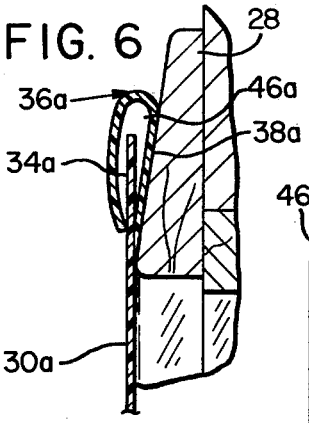
FIG. 8
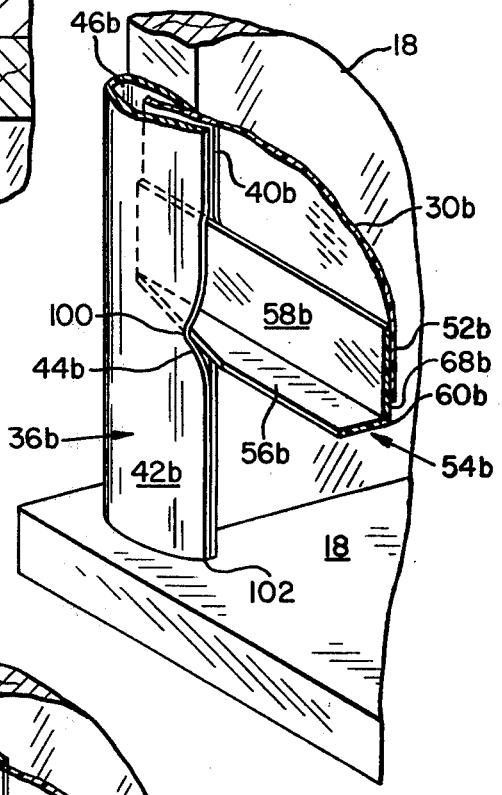
FIG. 7
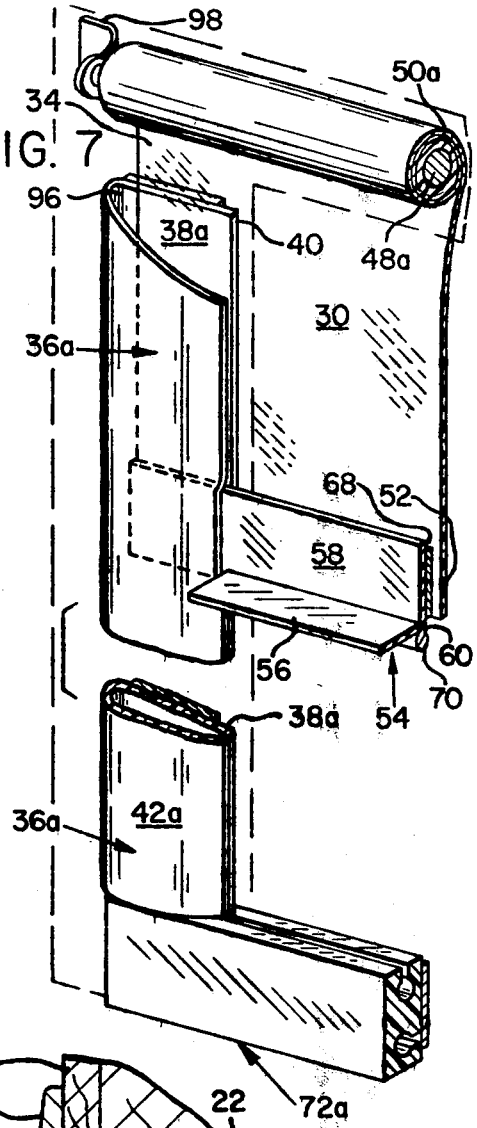
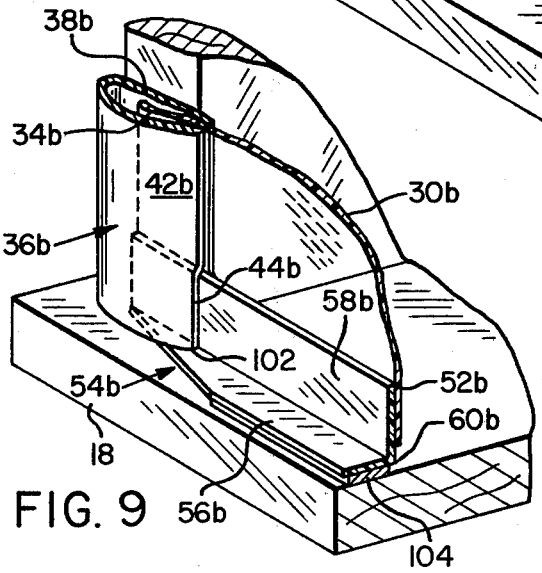
FIG. 9
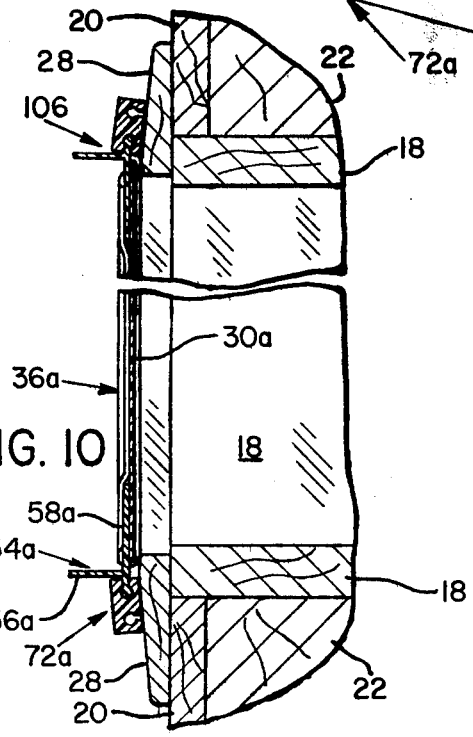
FIG. 10

FRAMING STRUCTURE FOR A FLEXIBLE PANE

BACKGROUND OF THE INVENTION

The present invention relates to assemblies for securing a one-piece flexible pane in an opening defined by a frame and more particularly to a window or door framing structure which may be utilized to mount a flexible plastic membrane in parallel spaced relation to an existing window glass or door panel to provide an insulating layer of air between the glass or panel and the pane.

Insulating windows and doors of various designs are widely used to conserve energy by preventing the escape of heat through windows and doors of residences and businesses. Because the use of such windows is seasonal, it is desirable for the panes used in such insulating windows and doors to be inexpensive and to be easily installed and removed. It is also desirable that they not substantially detract from the appearance of the building on which they are used.

Various storm window and door constructions have been used in the past. In such constructions, the pane is attached to a window or door frame in parallel spaced relation to the pane of the window glass or door to provide a layer of dead air between the glass or door and the pane for insulating against cold or heat.

Where flexible plastic membrane-type panes are used, these are commonly secured to the outside of a window frame by wooden strips nailed to the window frame. These have proved unsatisfactory because the wood strip is usually made of poor quality lath which often splinters or splits when nailed in place. Such wood strips are also unsightly and detract from the appearance of the building.

A variety of improved systems for installing plastic membranes have been patented, but most of these systems are unsuitable for home use because they require the installer to stretch the pane over the window opening and attach it to a surrounding frame using a bead which clamps a bite of the membrane in a groove in the frame. Installing a flexible pane using this system is exceedingly difficult even for an experienced installer because stretching the pane produces wrinkles which are difficult to remove.

Another construction includes framing strips permanently secured in window frames or in storm doors to mount rigid or semi-rigid panes. For support, such rigid panes typically are mounted in a metal sash or frame which meets with the door or window framing strips. Necessity of such a sash adds to the weight and expense of the construction and makes it impossible to utilize the framing strips for mounting panes or screening not having a compatible sash.

Insulating membranes which provide a suitable area of dead air in a window opening and can be easily opened or closed without being removed from the window frame are heretofore unknown.

SUMMARY OF THE INVENTION

The present invention is a structure which solves the above problems of the prior art and has many additional advantages. It includes two elongated channel members mounted on opposite sides of a window frame to receive and retain the edges of a flexible membrane. Each channel folds over on itself so that the edges of the pane are firmly grasped between the free edges of the flexible channel member.

One end of the pane may conveniently be convolutely wound around a window shade shaft mounted at one end of the frame. By pulling downwardly on the free end of such a pane, its boundary edges feed through the channels which hold the edges with sufficient gripping force that the pane may be released at any position and the channel members will hold the pane at the desired level.

At the end of the frame opposite the shaft, a positive closure is provided to seal the pane across the end of the frame. Attached to the free end of the pane, a rigid pane guide member with a downwardly projecting rib meets a resilient base strip attached to the frame. The base strip includes a channel or groove which receives and holds the rib of the pane guide member across the entire end of the frame to provide an air-tight seal.

A small air space is allowed between the shaft and the adjacent window casing member so that water vapor between the fixed pane of the window and the flexible membrane can escape instead of condensing between the panes. It is therefore desirable that the shaft be located parallel to the uppermost edge of the window frame to vent gasses between the panes which rise upwardly when heated by sunlight or heat transferred from ambient air inside the building.

The basic elements of the assembly can be combined in different ways to produce numerous embodiments. These variations make it possible to install the assembly on almost every type of window frame, even frames which are cylindrically curved. This versatile assembly consists of only three extruded framing members previously mentioned, i.e. channel members, base strips and pane guide members. Almost every installation can be completed using these three extrusions and some means for joining them together.

A particular feature of the components of the present assembly is their sturdy construction which enables them to be used many times.

It is therefore an object of the invention to provide improved window closure with means for tightly securing the side edges of a flexible plastic membrane in a window opening or in an opening of a storm door.

Another object is to provide an assembly which is inexpensive and easy to install.

A further object is to provide such an assembly which can be used with a wide variety of windows and door types and which can secure a flexible pane to either a facing surface extending perpendicularly to an existing window glass or door or to other flat window or door-frame surfaces.

An additional object is to provide an assembly which is attractive in appearance when installed and which can be either kept in place permanently or easily removed as desired.

It is also an object to provide an assembly with reusable members and easily replaceable membranes.

Still a further object is to provide an assembly which includes only three extrusions which can be used interchangeably for a variety of purposes.

An additional object is to provide an insulating membrane which allows water vapor to escape between two parallel panes and yet which provides good insulating properties.

Another object is to provide an assembly which can be used to interchangeably install clear panes, sun-reflective panes or window shades.

The foreqoing and other objects, features and advantages of the present invention will be more apparent from the following detailed description which proceeds with the reference to the accompanying drawings.

BRIEF DESCRIPTION OF THE DRAWINGS

In the drawings:

FIG. 1 is a cross-sectional view of a window showing a flexible pane secured by a first assembly in accordance with the present invention;

FIG. 2 is a partial sectional view taken along lines 2—2 of FIG. 1;

FIG. 3 is an enlarged partial plan view showing an upper corner of a window, including the assembly according to FIG. 1;

FIG. 4 is a perspective view of a cut-away portion of the assembly according to FIG. 1;

FIG. 5 is a partial cross-sectional view of a window showing a flexible pane secured by a second assembly in accordance with the present invention;

FIG. 6 is a partial sectional view taken along lines 6—6 of FIG. 5;

FIG. 7 is a perspective view of a cut-away portion of the assembly shown in FIG. 5;

FIG. 8 is a perspective view of a cut-away portion of a third assembly in accordance with the present invention showing the pane in a partially lowered position;

FIG. 9 is a perspective view of a cut-away portion of the assembly of FIG. 8 showing the pane in the fully closed position;

FIG. 10 is a partial cross-sectional view of a window showing a flexible pane secured by a fourth assembly in accordance with the present invention;

DESCRIPTION OF PREFERRED EMBODIMENTS

Figure 11:
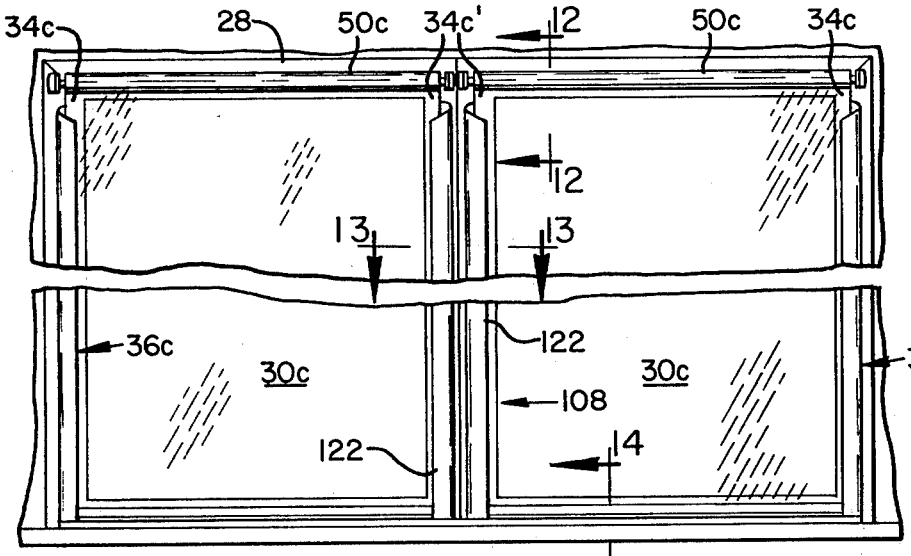
FIG. 11 is a partial plan view of a window assembly showing two flexible panes secured by a fifth assembly in accordance with the present invention.

With reference to FIG. 1, the window assembly includes a pane of window glass 10 set in a window frame or sash 12, secured in place near the exterior of a building 14 by a window sill 16 outside the window frame, such sill and a casing 18 comprising the window framework. The casing 18 is supported at its inside edge by a vertical inside wall partition 20 and a vertical outside wall partition 24. Horizontal framing members 22 extend between the inside wall partition 20 and the outside wall partition 24. The outside wall partition is covered with exterior siding 26. The inside edges of the casing 18 are covered by a molding strip 28.

In FIGS. 1-4, a clear flexible window pane 30 of a plastic material extends across the window opening defined by the horizontal and vertical casing members 18 in parallel-spaced relation to the window glass 10 so as to confine an insulating dead air space 32 between the window pane 10 and the membrane 30. The pane 30 is preferably made of Mylar which is strong and not subject to substantial stretching. Mylar sheets from three to five mils thick are suitable for most purposes with the greater thicknesses preferred for larger window openings.

Although they have superior properties, Mylar sheets have not been used in many window constructions because they may be damaged if bent around sharp corners. The framing assembly of the present invention requires no sharp bends in the flexible pane 30 and thus can accomodate a Mylar pane without difficulty. Vinyl and other common sheet materials can also be used, but are less preferred.

To insulate an existing window, the flexible pane 30 can be installed on either side of the fixed window pane. For ease of operation and to avoid discoloration of the flexible pane from contact with ultraviolet radiation in sunlight, the flexible pane 30 should be installed nearest the inside of the building.

The pane 30 includes two side boundary portions 34 which are secured to the broad surfaces of the vertical casing members 18 by attachment means which include opposed vertical edge channel members 36. The channel members are extrusions of semi-rigid plastic having cross-sections which are uniform throughout their entire length.

The edge channel members 36 are mounted parallel to one another on opposite vertical edges of the window assembly where they receive the side boundary portions 34 of the pane 30. Each of the channel members 36 has a substantially flat base portion 38 which terminates at a first free edge 40. The two opposite channel members are mounted such that their free edges 40 extend toward on another.

Each edge channel member also includes an arch portion 42 which terminates at a second free edge 44. The arch portion 42 is curved so that a space 46 is defined between the base portion 38 and arch portion 42 which are spaced a progressively decreasing distance apart in the direction of the free edges 40, 44.

As shown in FIG. 2, the free edges 40, 44 are located adjacent one another and are formed to exert a compressive gripping force against the side boundary portion 34 received in the space 46.

At the uppermost horizontal casing member 18, an upper end boundary portion of the pane 30 is secured to a spring-biased shaft 48 which is visible in FIGS. 1 and 3. The shaft 48 is mounted normal to the channel members 36 and is positioned so that the side boundary portions 34 of the pane 30 are in alignment with the channel members 36. A portion 50 of the pane 30 is convolutely wound around the shaft 48 so that the pane can be raised and lowered like a window shade.

A second or free end boundary portion 52 of the pane 30 extends downwardly from the shaft 48. To seal the free boundary edge portion 52 to the bottom of the window framework, a rigid elongated pane guide member 54 is attached to the free boundary end portion 52 of the pane 30.

The pane guide member 54 comprises an angle extrusion which has a uniform cross-section and which includes a base flange 56 and a support flange 58 which intersect at an angle of about 90° to form a corner 60. The base and support flanges have inner surfaces 62, 64 which face the inside of the corner 60 and outside surfaces 66, 68 which face the outside of the corner 60. A rib portion 70, which is substantially circular in cross section, extends outwardly from the corner 60 in a direction opposite that of the support flange 58.

A resilient elongated base strip 72 extends across the bottom horizontal casing member 18. This strip has a uniform, substantially rectangular cross-section, with four flat faces. As shown in FIG. 4, these include a grooved narrow face 74 located opposite an ungrooved narrow face 76 of substantially the same width. A grooved wide face 78 is located opposite an ungrooved wide face 80. Due to the rectangular shape of the base strip, the wide faces are wider than the narrow faces.

The grooved wide face 78 includes a longitudinal groove 86 which is identical in cross-section to the groove 82. This groove 86 is located a distance from the intersection of the ungrooved narrow face 76 and the grooved wide face 78, which is substantially equal to the distance between the groove 82 and the intersection of the grooved narrow face 74 and one of the wide faces 78, 80.

The base strip 72 is preferably made of a flexible material, such as vinyl, so that the groove openings will be expandable to admit the rib portion 70 of the pane guide member 54. The rib portion 70 is greater in diameter than the groove openings. Thus, to seal the pane 30 to the bottom casing member 18, the rib portion 70 may be pressed into one of the grooves 82, 86 in the base strip 72.

As previously mentioned, FIGS. 1–4 show an embodiment of the present framing assembly for use on the inside faces of window casing members 18. Because these casings members provide a flat base surface or sill, it is most convenient to mount the base strip 72 directly to the window frame with the ungrooved wide face 80 facing the lower horizontal casing member 18, as shown in FIGS. 1 and 4.

To mount the side channel members 36 and to partially close the area above the shaft 48, a number of additional members are needed to complete this embodiment. These additional members can all be formed from the base strip and angle extrusions previously described. In order to accomplish this multiple use of extrusions, it is important that the wide sides of the base strip extrusion are substantially the same width as the flange of the angle extrusion which corresponds to the base flange 56 of the pane guide member 54. The rib portion of the angle extrusion should extend outwardly from the base flange to a distance not greater than one-half the width of the narrow faces of the base strip extrusion. The significance of these relationships will become more apparent from the drawings and the following description.

In the interior mounting system of the first embodiment, the shaft 48 is rotatably mounted at its ends to opposite vertical casing members 18 in such a manner that the shaft is located within the area defined by the casing members and is closely spaced from the uppermost horizontal casing member 18.

A shaft sealing angle member 90, which may comprise the same extrusion as the pane guide member 54, extends parallel to the shaft 48 with the outer surface of the support flange of the shaft-sealing angle member 90 being mounted on the upper horizontal casing member 18 so that the inner surfaces of the flanges of the shaft-sealing angle member 90 are adjacent the portion 50 of the flexible pane 30 wound around the shaft 48.

As shown in FIG. 1, the angle member 90 closely conforms to the shape of the pane wrapped around the shaft 48 so that only a small gap is located there between. This small gap of about one half inch provides sufficient room for heated air inside the space 32 to escape, carrying water vapor along with it. It is sufficiently narrow that the insulating properties of the pane 30 are not significantly reduced.

Attached to each of the vertical casing members 18 is a channel-supporting flexible strip 92 as shown in FIGS. 2 and 4. This strip also comprises an extrusion identical to the base strip 72. The channel-supporting flexible strip 92 is attached along its ungrooved wide face so that it extends parallel to the vertical casing members.

Attached to each of the channel-supporting flexible strips 92 is a channel-supporting angle member 94. These angle members are identical in cross-section to the extrusions of the pane guide member 54. They are mounted so that the rib of the channel-supporting angle member 94 is received by the groove in the wide grooved face of the channel-supporting flexible strip 92 and the outer surface of the base flange of channel-supporting angle member 94 faces the grooved wide face of a channel-supporting flexible strip 92 so that the support flange extends toward the center of the window opening. The edge channel members 36 are respectively mounted on the channel-supporting angle members 94 with the base portions 38 of the channel members joined flat against the outer surfaces of the support flanges of the channel-supporting angle members 94. The free ends 40, 44 of the channel members 36 are aligned with the groove 86 of the base strip 72 so that the rib portions 70 of the pane guide member 54 will be in position to be received by the groove 86 when the pane 30 is fed through the edge channel members 36 and pulled to the bottom of the window opening.

For convenience in feeding the pane guide member 54 through the edge channel members 36, the pane guide member is constructed so that its outermost ends are received in the spaces 46 inside the channel members 36 as shown in FIGS. 2 and 3. For ease in inserting the pane guide member 54 into the edge channel members 36, the outermost portions of the base flange 56 are truncated so that only the support flange 58 and rib portion 70 extend into the opening 46. This arrangement can also be seen in FIG. 7. The free edges 40, 44 of the edge channel members 36 press against the opposite surface 64, 68 of the support flange 58 to maintain the support flange in a vertical plane.

As shown in FIGS. 3 and 7, the arch portion 42 of each channel member 36 tapers toward its junction with the base portion 38 in the direction of the upper end of channel member 36 to provide a notch 96 which facilitates the feeding of the side boundary portions 34 and the ends of the support flange 58 into the space 46 defined between the base and arch portions 38, 42.

Another embodiment of the invention is shown in FIGS. 5–7 wherein the framing assembly is secured on surfaces of the window frame which face in the same general direction of the opening, e.g. inwardly facing surfaces of the molding strips 28. This embodiment can be used on a window frame that has no horizontal casing members.

A shaft **48*a* is mounted on the uppermost horizontal molding strip by means of brackets 98 which hold the shaft a short distance away from the molding strip. As best seen in FIG. 6, edge channel members 36*a* are mounted directly to the vertical molding strips 28 by the base portions 38*a*. A wide face of the base strip 72*a* is mounted on an outwardly facing surface of the lowermost horizontal molding strip 28 with the opening in the grooved narrow face of the base strip 78***a* facing the shaft 48*a*.

Some windows have no casings whatsoever, in such instances. the assembly shown in FIGS. 5–7 may be installed by first securing angle extrusions on the wall surface surrounding the window opening using a base strip extrusion so that the angle extrusions are secured on the wall in the same way that the channel-supporting angle member 94 is secured to the vertical casing members 18 as shown in FIGS. 2 and 4. Once in place, the extrusions serve the purpose of the molding strips as a base for mounting other members of the assembly.

FIGS. 8 and 9 show an alternative method for sealing the free boundary end portion 52*b* of a pane 30*b* on the bottom horizontal casing member 18 of a window frame. This embodiment includes an alternative pane guide member 54*b* which corresponds exactly in cross-section to the previously described pane guide member 54 except that it does not include a rib portion. The member 54*b* is of sufficient length that its ends extend into the spaces 46*b* defined by the channel members 36*b* at opposite sides of the window framework. Instead of a truncated base flange, this embodiment includes a base flange 56*b* which tapers toward the corner 60*b* as it approaches the ends of the pane guide member 54*b*. A support flange 58*b* includes an outer surface 68*b* which abuts the base portion 38*b* of the channel member 36*b* when the ends of the pane guide member 54 are received by the channel members 36*b*.

Because a portion of the base flange 56*b* extends into the space 46*b* a bulge 100 occurs in the arch portion 42*b* opposite the location of the base flange 56*b*. When, however, the pane guide member 54*b* is moved to its lowermost position, the base flange 56*b* is located below the lowermost end 102 of the second free edge 44*b*. The end 102 snaps over the base flange 56*b*, thereby locking the guide member 54*b* as shown in FIG. 9. To raise the pane 30*b*, it is then necessary to pull the end 102 outwardly of the base flange 56*b* or to pull the pane guide member 54*b* sideways out of the channel member 36*b*. A layer of insulating material 104, such as sponge or felt, may be provided on the outer surface of the base flange 56*b*. This material contacts the bottom horizontal casing member 18 to form a seal.

Still another embodiment is shown in FIG. 10. This embodiment is identical to the embodiment shown in FIGS. 5–7 except that no shaft is required. Instead, an additional horizontal pane guide member and base strip combination 106 is provided for securing the uppermost end boundary portion of the pane 30*a* to the top horizontal molding strip 28.

Turning to FIGS. 11–14, it can be seen that the present invention can be used for large window openings and as sliding glass doors, to provide an insulating membrane across the entire area of the door and yet allow easy access therethrough. The edge channel members 36*c* of this construction may be of a type previously described, e.g. those shown in FIG. 6. Two rollers with convolutely wrapped pane portions 50*c* are mounted end to end in one of the manners previously described so that the outermost side boundary portions 34*c* of the panes 30*c* are aligned with the edge channel members 36*c*.

To provide support and sealing with the other side boundary portions 34*c* of the panes 30*c*, a central edge guide structure 108 is located vertically between the panes 30*c*. The structure has two free ends which mount to the top and bottom of the door frame structure respectively. It is constructed from the extrusions previously described which are combined to provide a structure that is rigid along its longitudinal axis, but which will twist about that axis to relieve the stress which results when air currents strike the surfaces of the panes 30*c*.

Figure 13:
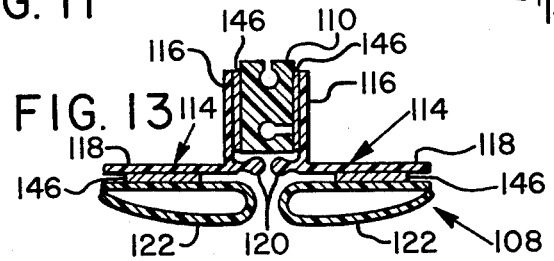
FIG. 13 is a sectional view taken along lines 13—13 of FIG. 11, only with flexible panes removed.

As can be best seen in FIG. 13, the structure 108 includes a resilient elongated core strip 110 with a uniform rectangular cross-section. The strip has opposed pairs of narrow and wide faces and is oriented so that the wide faces face toward the edge channel members 36*c*. Most conveniently this core strip can comprise the same extrusion used for the base strip 72.

Two rigid, elongated central angle members 114 are mounted on the core strip 110. Each angle member has a uniform cross-section which includes a base flange 116 which is substantially the same width as the wide faces of the core strip. A support flange 118 intersects the base flange 116 at about 90° to form a corner; and a rib portion 120 extends outwardly from the corner in a direction opposite the support flange 118 to a distance not greater than one half the width of the narrow face of the core strip. Both the base and support flanges 116, 118 have outer surfaces which face the outside of the corner. The central angle members 114 attach to the two wide faces of the core strip 110 at the outer surfaces of the base flanges 116 in such a manner that the support flanges 118 of both central angle members 114 are coplanar and extend parallel to the edge channel members 36*c*.

Central channel members 122 are respectively mounted on the support flange 118 of the central channel members 114 with the base portions of the central channel members 122 parallel and joined to the corresponding outer surfaces of the support flanges 118. These two central channel members 122 open outwardly in the opposite directions.

Attachment means are provided for securing the ends of the guide structure 108 to the window framework. To facilitate attachment, the end portions of the support flanges 118 of the central angle members 114 extend longitudinally outwardly of the guide structure 108 beyond all other portions thereof. These extending end portions have openings therethrough to receive screws.

Figure 12:
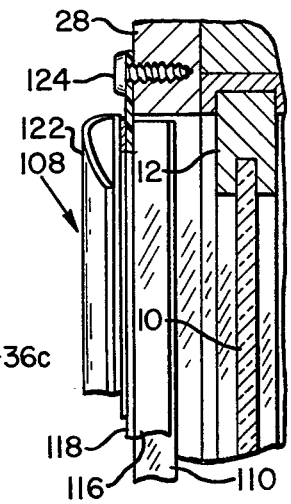
FIG. 12 is a partial sectional view taken along lines 12—12 of FIG. 11.

As shown in FIG. 12, the upper end of the central edge guide structure can frequently be secured simply by positioning a screw 124 in the opening and threading it into a portion of the window frame structure, in this instance the upper horizontal molding strip 28. For securing the central edge guide structure 108 at the base of a door opening, there is frequently no convenient vertical surface to receive such a screw. In such an instance, the base of the central edge guide structure 108 can be secured by one of the arrangements shown in FIGS. 14A or 14B.

Both these arrangements include an elongated attachment angle member which has a uniform cross-section and which includes a base flange and a support flange intersecting the base flange at about 90° to form a corner. This angle member can comprise the same extrusion used for the previously described pane guide member 54. The attachment angle member is positioned normal to the guide structure 108 with the support flange of the attachment angle member located in a plane perpendicular to the longitudinal axis of the guide structure 108. An outer surface of the base flange of the attachment angle member abuts a surface of one of the end portions of the support flanges 118 of the central angle members 114. A first screw means is provided for attaching the support flange of the attachment angle members to the floor 132. A second screw means is provided for attaching the base flange of the attachment angle member to the guide structure 108.

Figure 14A:
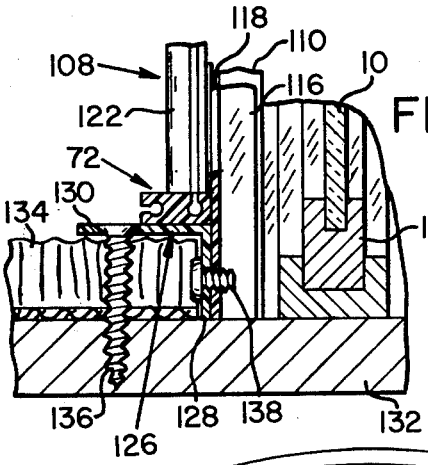
FIG. 14A is a partial sectional view taken along lines 14—14 of FIG. 11.

FIG. 14A shows an arrangement specifically designed for use when the floor 132 is covered with a layer of carpeting 134. In this instance, an attachment angle member 126 has a support flange 130 located above the carpet with a first screw 136 extending down through the support flange 130 and carpeting 134 into the floor 132. A second screw 138 joins a base flange 128 of the attachment angle member 126 to the support flange 118 of the guide structure 108.

Figure 14B:
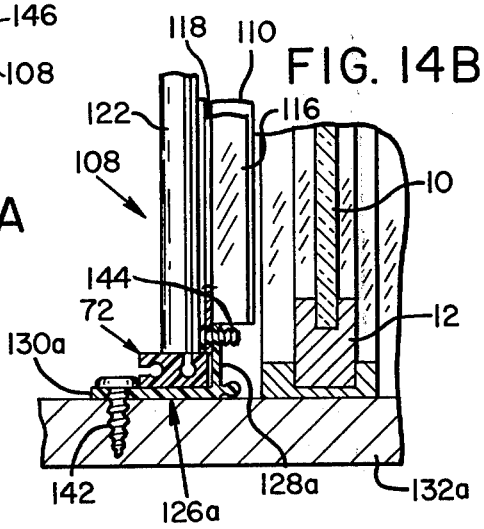
FIG. 14B is a partial sectional view taken along lines 14—14 of FIG. 11 showing an alternative construction.

FIG. 14B shows an alternative arrangement with the lower end of the guide structure 108 secured to an uncarpeted wooden floor 132*a*. An attachment angle member 126*a* includes a support flange 130*a* which lies flat on the floor 132*a* with a first screw 142 securing these elements together. A base flange 128*a* extends upwardly from the support flange 130*a* and is attached by a second screw 144 to the support flange 118 of the guide structure 108.

Figure 15:
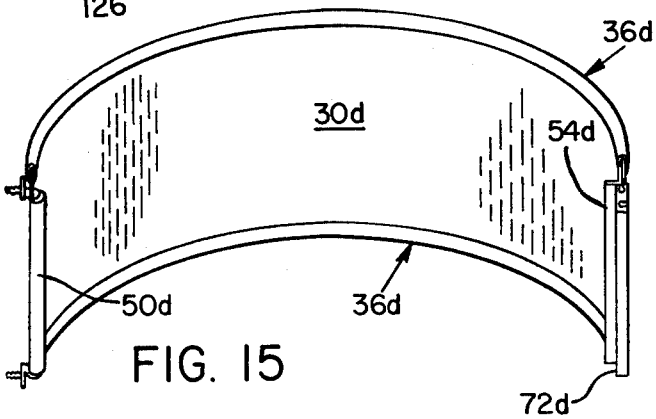
FIG. 15 is a perspective view of a curved window assembly showing a flexible pane secured by a sixth assembly in accordance with the present invention.
Figure 16:
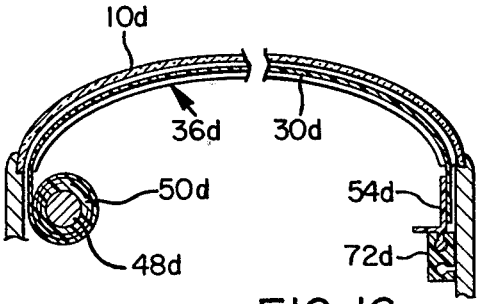
FIG. 16 is an enlarged partial sectional view taken along lines 16—16 of FIG. 15.

FIGS. 15 and 16 show a framing assembly according to the present invention mounting a flexible pane over a curved window opening. The illustrated embodiment is an insulating pane mounted over a partial cylindrical window of the type used for wrap-around windows in motor homes and similar vehicles. This embodiment can be assembled from the extrusions previously described provided that the edge channel members 36*d* are sufficiently flexible to conform to the surfaces of the window frame.

Operation

In practice, assemblies according to the present invention are installed by first measuring the window opening to determine its dimensions. Next the needed extrusions are cut to the proper length and assembled to form the various elements of the assembly. The extrusions can be joined with glue or screws but preferably are attached using a double-backed adhesive tape 146 shown in FIG. 13.

If a shaft is used to hold one free end of the pane, it is the first element to be mounted on the window frame. The shaft is tested for plumbness and then the pane is pulled across the window opening to determine whether its side boundary positions are parallel to edges of the window frame. Any necessary adjustment of the shaft position is made at this time.

Next the side channel members are installed in appropriate alignment with the shaft so that the channel members can receive the side boundary portions of the pane. Finally the base strip, if any, is secured to the frame so that it is in alignment with the ends of the channel members which are opposite the shaft.

The various elements are fastened to surfaces of the casing members 18 so that the free edges 40, 44 of the edge channel members 36 extend toward the center of the opening. If the pane is to be used to trap an insulating layer of air in the window opening, the framing members should be positioned parallel to and spaced equally from the window glass 10, on either side of the glass.

Various methods may be used for securing the elements to the window frame. Tacks, screws, glue or double-backed adhesive tape are all acceptable. Tape is the easiest and is preferred in most applications. However, if the elements are lengthy or are mounted by a flexible base strip extrusion, tacks are preferred, because the elements have a tendency to creep relative to the tape over an extended period of time.

Once installed, the pane 30 may be easily opened or closed merely by raising or lowering pane guide member 54. In embodiments which include a spring biased shaft 48, the pane will automatically roll onto the shaft when the pane guide member is raised. The same pane will unroll automatically and feed through the edge channel members when it is pulled downwardly. If it is desired to remove the pane from the window for the purpose of storage or cleaning, this can easily be accomplished by raising the pane so that it wraps completely around the shaft 48 and then removing the shaft from its brackets.

Having illustrated and described preferred embodiments of my invention, it will be apparent to those skilled in the art that modifications and changes may be made without departing from my invention in its broader aspects. For example, partially reflective Mylar or opaque membranes may be substituted for the clear plastic pane described above. In this manner the assembly can be used as either a sun screen or an insulating window shade as desired.

I claim:

1. A window assembly for an opening defined by a frame, comprising:

a one-piece flexible pane having two side boundary portions parallel to each other and two end boundary portions, the pane being made of plastic membrane material; and two elongated semirigid edge channel members of uniform cross section which are mounted parallel to one another on opposite edges of the frame to receive the side boundary portions of the pane, each of the channel members having a substantially flat base portion terminating at a first free edge that extends toward the opposite channel member and an arch portion terminating at a second free edge and extending from the base portion toward the first free edge so that a space is defined between the base and arch portions, said base and arch portions being spaced a progressively decreasing distance apart in the direction of the free edges, the free edges abutting one another exerting compressive gripping forces at directly opposite locations on the faces of side boundary portions inserted between the free edges so that the free edges grip the side boundary portions without exerting torquing forces thereagainst.

2. The assembly of claim 1 further comprising a spring biased shaft rotatably mounted normal to the channel members at one edge of the frame, one of the end boundary portions of the pane being attached to the shaft, the other end boundary portion comprising a free end boundary portion, and at least a portion of the pane being convolutely wound around the shaft, said side boundary portions being slidably gripped by said free edges, such that as said free end portion is moved in directions normal to said shaft to move the pane between open and closed positions said side boundary portions slide within the spaces while being gripped by said free edges.

3. The assembly of claim 2 further comprising:

a resilient, elongated base strip with a uniform, substantially rectangular cross-section, the base strip having four flat faces and a longitudinal groove extending inwardly from an opening in one of the faces, the groove being substantially circular in cross-section with the width of the opening being less than the diameter of the groove, the base strip being mounted adjacent an edge of the frame opposite the one edge at which the shaft is mounted; and a rigid elongated pane guide member fixedly attached to the free end boundary portion of the pane and including a straight rib portion which is substantially circular in cross-section with a diameter which is greater than the width of the opening in the base strip so that the rib portion is removably securable in the groove.

4. In an assembly for securing a one-piece flexible pane, having two side boundary portions parallel to each other and two end boundary portions, within an opening defined by a frame, the improvement comprising:

two elongated edge channel members of uniform cross section which are mounted parallel to one another on opposite edges of the frame to receive the side boundary portions of the pane, each of the channel members having a substantially flat base portion terminating at a first free edge that extends toward the opposite channel member and an arch portion terminating at a second free edge and extending from the base portion toward the first free edge so that a space is defined between the base and arch portions which are spaced a progressively decreasing distance apart in the direction of the free edges, the free edges being located adjacent one another so that the free edges exert a compressive gripping force against the side boundary portions received in the space;

a spring biased shaft rotatably mounted normal to the channel members at one edge of the frame, one of the end boundary portions of the pane being attached to the shaft, the other end boundary portion comprising a free end boundary portion, and at least a portion of the pane being convolutely wound around the shaft;

a resilient, elongated base strip with a uniform, substantially rectangular cross section, the base strip having four flat faces and a longitudinal groove extending inwardly from an opening in one of the faces, the groove being substantially circular in cross section with the width of the opening being less than the diameter of the groove, the base strip being mounted adjacent an edge of the frame opposite the one edge at which the shaft is mounted;

a rigid elongated pane guide member fixedly attached to the free end boundary portion of the pane and including a straight rib portion which is substantially circular in cross section with a diameter which is greater than the width of the opening in the base strip so that the rib portion is removably securable in the groove;

the four faces of said base strip comprising a grooved narrow face, an ungrooved narrow face, a grooved wide face, and an ungrooved wide face, the wide faces being opposite one another and wider than the narrow faces;

the grooved narrow face having the longitudinal groove centered therein;

the grooved wide face having an identical groove therein located at a distance from the intersection of the ungrooved narrow face and the grooved wide face which is substantially equal to the distance between the groove in the grooved narrow face and the intersection of the grooved narrow face and one of the wide faces; and the pane guide member comprising an angle member which has a uniform cross section and includes a base flange and a support flange intersecting the base flange at about 90° to form a corner, both the flanges having inner surfaces which face the inside of the corner and outer surfaces which face the outside of the corner, the rib portion extending outwardly from said corner in a direction opposite from the support flange.

5. The assembly of claim 4 wherein:

the wide faces of the base strip are substantially the same width as the base flange of the pane guide member; and the rib portion of the pane guide member extends outwardly from the base flange to a distance not greater than one half the width of the narrow faces of the base strip.

6. The assembly of claim 5 adapted to be mounted in an opening surrounded by four flat casing members, wherein:

the shaft is rotatably mounted at its ends to opposite casing members in such a manner that the shaft is located within an area defined by the casing members and is closely spaced from and extends parallel to a first of the casing members which extends between the two opposite casing members;

a shaft-sealing flexible strip, identical in cross-section to the base strip, is attached along one of its wide faces to the first casing member, between the first member and the shaft, and extends parallel to said shaft;

a shaft-sealing angle member, identical in cross-section to the pane guide member, extends parallel to the shaft with the outer surface of the support flange of the shaft-sealing angle member mounted on the free wide face of the shaft-sealing flexible strip so that the inner surfaces of the flanges of the shaft sealing angle member are adjacent the flexible pane wound about the shaft;

attached to each of said opposite casing members is a channel-supporting flexible strip, identical in cross-section to the base strip, the strip being attached along one of its wide faces so that it extends parallel to the opposite casing members;

attached to each of said channel supporting flexible strips is a channel-supporting angle member, identical in cross-section to the pane guide member, with the outer surface of the base flange of the channel-supporting angle member mounted on the free wide face of the channel-supporting flexible strip so the support flange extends toward the center of the opening;

the channel members are respectively mounted on the channel-supporting angle members with the base portions of the channel members parallel and joined to the corresponding outer surfaces of the support flanges of the channel-supporting angle members; and the ungrooved wide face of the base strip is mounted to a second transverse casing member extending between the opposite casing members, with the base strip positioned in relation to the other members of the assembly so that the groove in the grooved wide face of the base strip is in a suitable location to receive the rib portion of the pane guide member.

7. The assembly of claim 3 wherein a wide face of the base strip is mounted on a surface of the frame which faces in the same general direction as the opening with the grooved narrow face of the base strip facing the shaft.

8. The assembly of claim 1 wherein the base portions of the channel members are mounted on surfaces of the frame which face in the same general direction as the opening.

9. In an assembly for securing a one-piece flexible pane, having two side boundary portions parallel to each other and two end boundary portions, within an opening defined by a frame, the improvement comprising:

two elongated edge channel members of uniform cross section which are mounted parallel to one another on opposite edges of the frame to receive the side boundary portions of the pane, each of the channel members having a substantially flat base portion terminating at a first free edge that extends toward the opposite channel member and an arch portion terminating at a second free edge and extending from the base portion toward the first free edge so that a space is defined between the base and arch portions which are spaced a progressively decreasing distance apart in the direction of the free edges, the free edges being located adjacent one another so that the free edges exert a compressive gripping force against the side boundary portions received in the space;

two resilient elongated base strips each having a uniform substantially rectangular cross-section, four flat faces, and a longitudinal groove extending inwardly from an opening in one of the faces, the groove being substantially circular in cross-section with the width of the opening being less than the diameter of the groove, the base strips being respectively mounted adjacent opposite edges of the frame which are transverse to the channel members; and two rigid elongated pane guide members fixedly attached respectively to the two end boundary portions of the pane, each of the pane guide members including a straight rib portion which is substantially circular in cross-section with a diameter which is greater than the width of the openings in the base strips so that each of the rib portions is securable in one of the grooves.

10. In an assembly for securing two one-piece flexible panes side by side in a single opening defined by a frame, each such pane having two side boundary portions parallel to each other and two end boundary portions, the improvement comprising:

two elongated edge channel members of uniform cross-section which are mounted parallel to one another on opposite edges of the frame to receive the side boundary portions of the pane, each of the channel members having a substantially flat base portion terminating at a first free edge that extends toward the opposite channel member and an arch portion terminating at a second free edge and extending from the base portion toward the first free edge so that a space is defined between the base and arch portions which are spaced a progressively decreasing distance apart in the direction of the free edges, the free edges being located adjacent one another so that the free edges exert a compressive gripping force against the side boundary portions received in the space;

a central edge guide structure located between and parallel to the edge channel members, said structure extending entirely across the opening, having two free ends and including:

a. a resilient elongated core strip with a uniform rectangular cross-section, the strip having pairs of opposed narrow and wide faces oriented so that the wide faces face toward the edge channel members, b. two rigid elongated central angle members each of which has a uniform cross-section and which includes a base flange which is substantially the same width as the wide faces of the core strip, a support flange intersecting the base flange at about 90° to form a corner and a rib portion extending outwardly from said corner in a direction opposite said support flange to a distance not greater than one half the width of the narrow faces of the core strip, both the base and support flanges having outer surfaces which face the outside of said corner, the central angle members being respectively attached at the outer surfaces of their base flanges to the two wide faces of the core strip in such a manner that the support flanges of both central angle members are coplanar and extend parallel to the edge channel members, and c. two elongated central channel members, identical in cross-section to the edge channel members, the central channel members being respectively mounted on the central angle members with the base portions of the central channel members parallel and joined to the corresponding outer surfaces of the support flanges of the central angle members in such a manner that the two central channel members open outwardly in opposite directions; and attachment means for securing the ends of the guide structure to the frame.

11. The assembly of claim 10 wherein:

end portions of the support flanges of the central angle members extend outwardly of the guide structure beyond all other portions thereof; and the end portions have openings therethrough.

12. The assembly of claim 11 wherein the attachment means comprises a screw received by one of the openings and threaded into the frame.

13. The assembly of claim 11 wherein the attachment means comprises:

an elongated attachment angle member which has a uniform cross-section and which includes a base flange and a support flange intersecting the base flange at about 90° to form a corner, the attachment angle member being positioned normal to the guide structure with the support flange of the angle member being located in a plane perpendicular to the guide structure and an outer surface of the base flange abutting a surface of one of the end portions of the support flanges of the central angle members;

screw means for attaching the support flange of the attachment angle member to the frame; and screw means received by one of the openings and threaded into the abutting base flange of the attachment angle member for attaching the guide structure thereto.

14. The assembly of claim 1 wherein the edge channel members are sufficiently flexible that they may be bent to conform to the opposite curved edges of a frame which defines a partially cylindrical opening.

15. The assembly of claim 1 wherein the arch portion of each channel member tapers toward its junction with the base portion in the direction of one of the ends of the channel member to provide a notch 96 which facilitates the feeding of the side boundary portions into the spaces defined between the base and arch portions.

16. In an assembly for securing a one-piece flexible pane, having two side boundary portions parallel to each other and two end boundary portions, within an opening defined by a frame, the improvement comprising:

two elongated semirigid edge channel members of uniform cross section which are mounted parallel to one another on opposite edges of the frame to receive the side boundary portions of the pane, each of the channel members having a substantially flat base portion terminating at a first free edge that extends toward the opposite channel member and an arch portion terminating at a second free edge and extending from the base portion toward the first free edge so that a space is defined between the base and arch portions, said base and arch portions being spaced a progressively decreasing distance apart in the direction of the free edges, the free edges abutting on another such that the free edges exert a compressive gripping force against the side boundary portions inserted between the free edges and the space;

a spring biased shaft rotatably mounted normal to the channel members at one edge of the frame, one of the end boundary portions of the pane being attached to the shaft, the other end boundary portion comprising a free end boundary portion, and at least a portion of the pane being convolutely wound around the shaft, said side boundary portions being slidably gripped by said free edges, such that as said free end portion is moved in directions normal to said shaft to move the pane between open and closed positions said side boundary portions slide within the spaces while being gripped by said free edges; and a rigid elongated pane guide member, said guide member including a base flange and a support flange intersecting the base flange at about 90° to form a corner, the edge of said base flange spaced from the corner comprising a free edge, said support flange being attached to the free end boundary portion of the pane, both the flanges having outer surfaces which face the outside of the corner, the guide member being of sufficient length such that, with the guide member positioned between the channel members and parallel to said shaft, the ends of the guide member can simultaneously be received by the spaces defined in the channel members, the free edge of said base flange tapering toward the corner adjacent the ends of the guide member to facilitate sliding of the guide member within the spaces as the pane is moved between open and closed positions, and said support flange being positioned so that end portions of the outer surface of the support flange abut the base portions of the channel members when the pane is moved between such open and closed positions.

* * * * *